US006015124A

United States Patent [19]

Loy

[11] Patent Number: 6,015,124

[45] Date of Patent: Jan. 18, 2000

[54] BRACKET ASSEMBLY FOR CARRYING SIGNAGE FOR A RETAIL DISPLAY FIXTURE

[75] Inventor: Kenneth Loy, Alliance, Ohio

[73] Assignee: Darko Company, Inc., Twinsburg, Ohio

[21] Appl. No.: 08/932,856

[22] Filed: Sep. 18, 1997

[51] Int. Cl.[7] ..... A47B 96/06

[52] U.S. Cl. ..... 248/220.31; 40/606

[58] Field of Search ..... 248/220.31, 220.41, 248/220.42, 220.43, 911, 912; 40/606, 610, 611, 620, 657

[56] References Cited

U.S. PATENT DOCUMENTS

| | | | |
|---|---|---|---|
| 4,155,459 | 5/1979 | Marschak | 248/220.41 |
| 4,884,351 | 12/1989 | Abramson | 40/611 |
| 5,388,359 | 2/1995 | DeWitt | 40/606 |
| 5,666,751 | 9/1997 | Garfinkle | 40/611 |

OTHER PUBLICATIONS

Two (2) Sheets of Advertisements from "Fasteners for Retail" Brochure (Apr. 1996).

*Primary Examiner*—Ramon O. Ramirez
*Attorney, Agent, or Firm*—Renner, Kenner, Greive, Bobak, Taylor & Weber

[57] ABSTRACT

A retail display system (10) for mounting a sign (12) to a fixture (11) includes a bracket assembly (14). The bracket assembly (14) includes a first portion (20) mountable on the fixture (11) and a second portion (21) which is slidable relative to the first portion (20) to adjust the height of the sign (12) carried by the second portion (21). The sign (12) may be carried by an extrusion member (13) which can be attached to the second portion (21) of the bracket assembly (14).

27 Claims, 4 Drawing Sheets

BRACKET ASSEMBLY FOR CARRYING SIGNAGE FOR A RETAIL DISPLAY FIXTURE

TECHNICAL FIELD

This invention relates to a bracket assembly for mounting retail display signage to a display wall or fixture. More specifically, this invention relates to such an assembly which can hold the signage at adjustable heights and which is particularly suited for a pegboard-like display fixture.

BACKGROUND ART

Many retailers display their goods by hanging them on aisle display walls or positioning them on shelves carried by the display walls or fixtures. Since such walls do not normally extend higher than the viewing or reaching height of the purchasers, the retailer often desires to place signage above the wall to describe or otherwise promote the products being displayed on the wall.

There are a wide variety of manners in which to mount signage to the top cap of a fixture, such as a pegboard wall, but none have proven to be totally satisfactory. For example, small signs can be clipped to the top cap at longitudinally spaced locations along the wall, which signs then extend laterally outward from the wall. However, such signage is often difficult to observe and otherwise presents a cluttered look not desirable for retail display. Moreover, because the top caps of the walls normally just rest on top of opposed and spaced pegboard sheets, such cannot normally stably hold the plurality of signs.

Thus, the retailer prefers a sign that might extend substantially along the longitudinal direction of the fixture without extending laterally therefrom. While such is more aesthetically pleasing, the mounting thereof still presents many of the same problems. In one such system, a sign holder is merely attached to the top cap of the fixture wall and a sign is retainable therein. Alternatively, the entire metal top cap is replaced with a cap that is in the shape of a sign holder. However, such an arrangement still presents a stability problem and often the cap will cock somewhat on top of the fixture creating a leaning sign. Moreover, because these prior art systems require that the bottom of the sign be generally coincident with the top of the fixture or wall, the retailer is limited as to the type of product which can be displayed near the top of the wall. That is, for example, if a tall product were displayed on a shelf mounted near the top of the wall, the message on the sign could well be obscured.

The need exists, therefore, for a system to mount a sign longitudinally along a display wall which is stable and which is height adjustable so as a product carried by the wall will not obstruct the visibility of the sign.

DISCLOSURE OF THE INVENTION

It is thus an object of the present invention to provide a system of mounting signage to the top of a retail display fixture or wall.

It is another object of the present invention to provide a system, as above, which can stably mount the signage longitudinally along the fixture of the wall.

It is a further object of the present invention to provide a system, as above, in which products carried by the fixture or wall will not obstruct the view of the signage.

It is yet another object of the present invention to provide a system, as above, which is particularly suitable for a pegboard fixture or wall.

It is an additional object of the present invention to provide a system, as above, which includes a height adjustable bracket attached to the pegboard fixture or wall and carrying the signage.

It is a still further object of the present invention to provide a system, as above, which is capable of carrying multiple pieces of signage.

It is yet a further object of the present invention to provide a system, as above, which is easy to install and simple to adjust.

These and other objects of the present invention, as well as the advantages thereof over existing prior art forms, which will become apparent from the description to follow, are accomplished by the improvements hereinafter described and claimed.

In general, a bracket assembly to attach a sign to a display fixture includes a first plate carried by the fixture and a second plate adapted to carry the sign and extending above the fixture.

In accordance with another aspect of the present invention, the bracket assembly has a first portion attachable to the fixture and a second portion slidable relative to the first portion. The second portion is adapted to carry the sign such that the sign is carried at a predetermined position relative to the fixture.

At least one bracket assembly is used in a retail display system which, in addition to the sign and the fixture, can include a sign carrying member which is carried by the bracket.

A preferred exemplary system for mounting signage to a display fixture incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
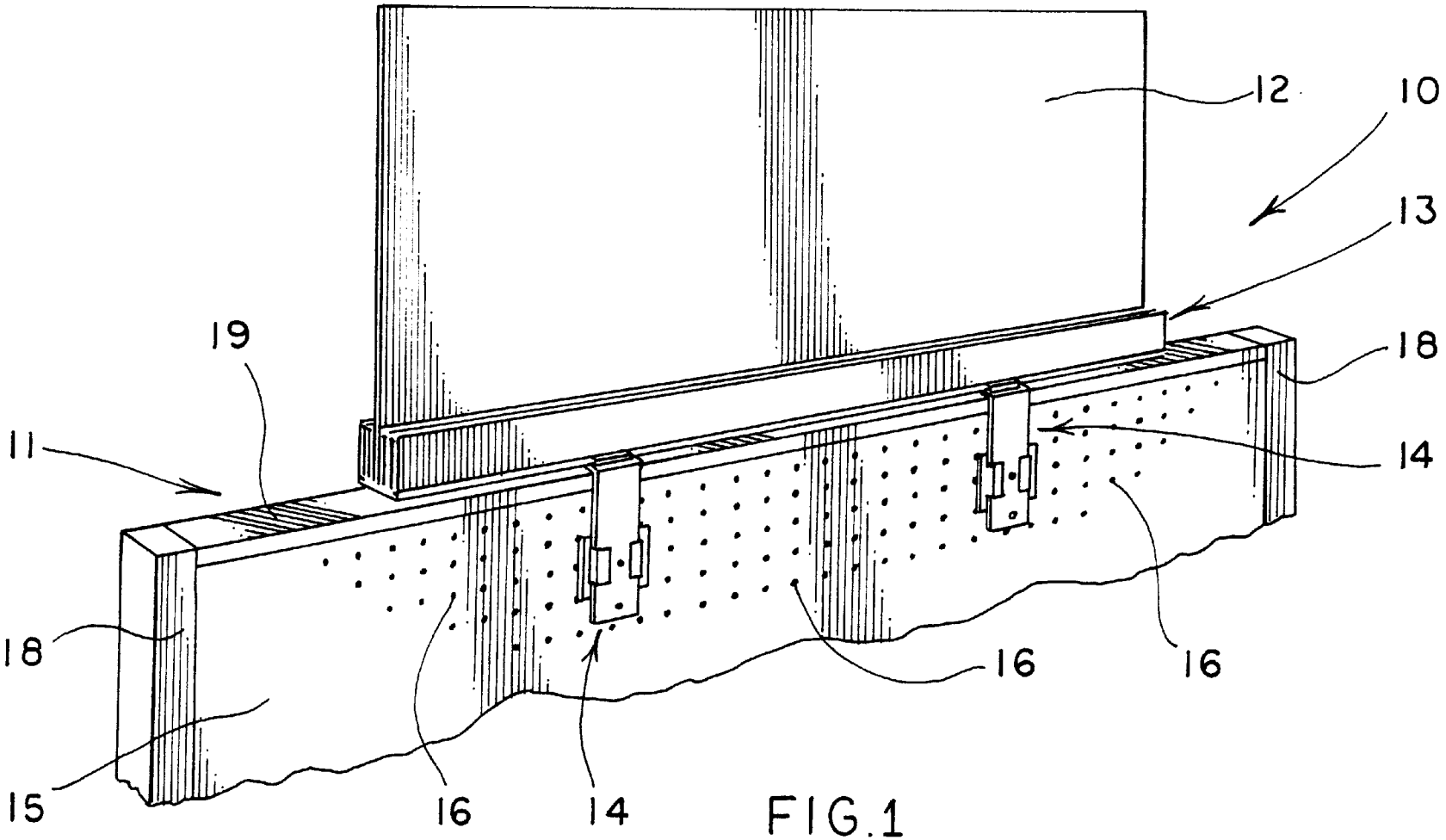
FIG. 1 is fragmented, perspective view of a system made in accordance with the present invention showing two bracket assemblies mounting signage to a retail display fixture or wall.

A retail display system made in accordance with the present invention is indicated generally by the numeral 10 in the accompanying drawings and includes a fixture, generally indicated by the numeral 11, a display sign 12 carried by an extruded holder, generally indicated by the numeral 13, and bracket assemblies, generally indicated by the numeral 14, which mount extruded holder 13 and sign 12 to fixture 11.

Figure 5:
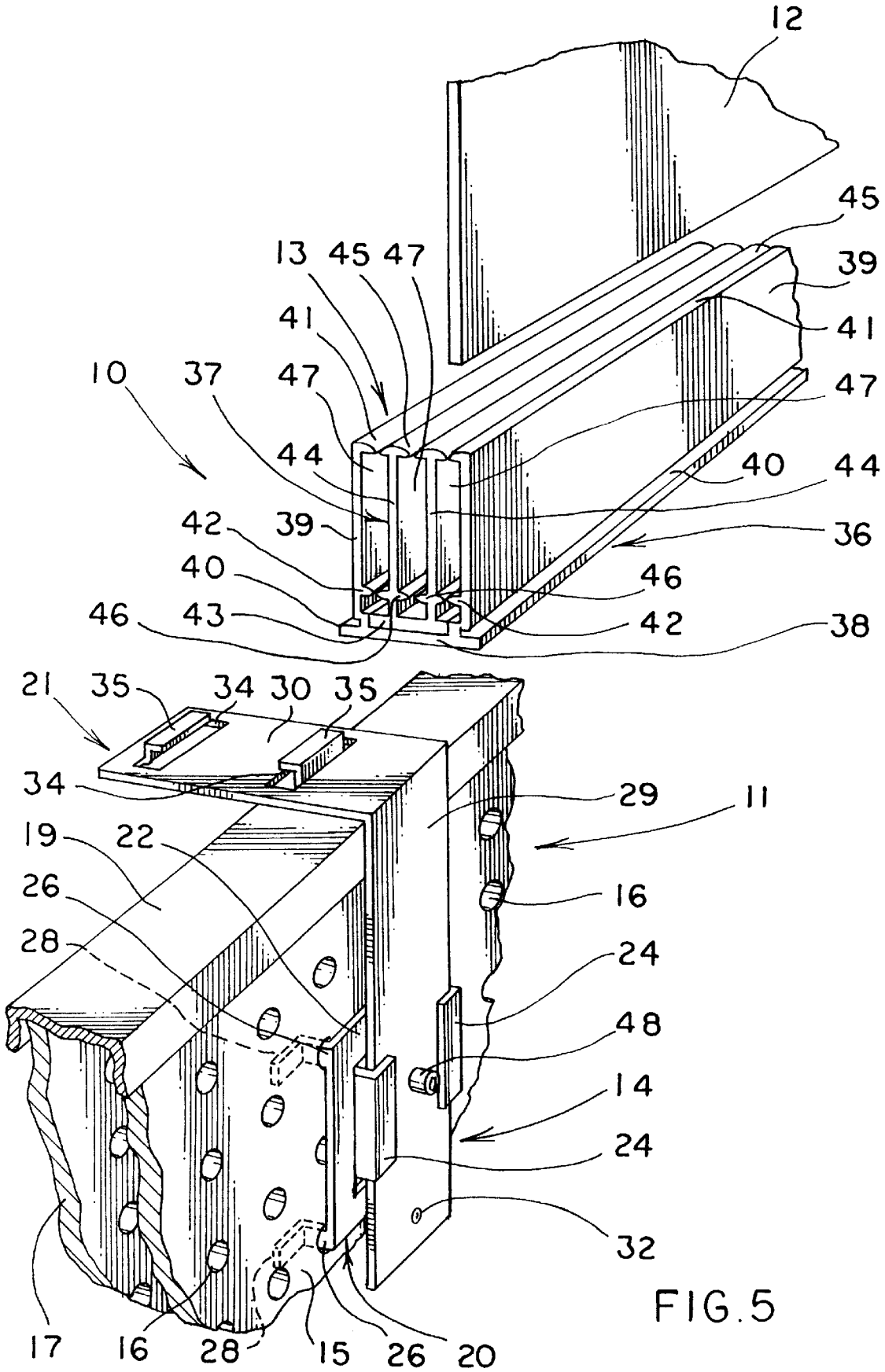
FIG. 5 is an exploded, fragmented, perspective view depicting the manner in which the system shown in FIG. 1 is assembled.

Fixture 11 may take on any configuration, such as the popular gondola configuration used by many retail establishments to display their wares, but in its simplest form is shown as a conventional pegboard wall 15 having its traditional plurality of holes 16 punched therein in a regular horizontal and vertical row pattern. As shown in FIG. 5, fixture 11 can also include a second pegboard wall 17, spaced from and opposed to wall 15, so that if fixture 11 is utilized, for example, as a store aisle divider, the merchandiser may display wares on both sides of fixture 11. End edge caps 18 and a top cap 19, usually made of a metallic material, may be provided to give fixture 11 a finished look. Fixture 11 is thus utilized to display the wares of the merchandiser as by hanging the wares from hooks carried by holes 16 or by placing the wares on small shelves attached to holes 16. Display sign 12 may be provided with any message concerning the goods to promote their sale.

Each bracket assembly 14 includes a wall mountable portion, generally indicated by the numeral 20 and adapted to be attached to wall 15, and a slide portion, generally indicated by the numeral 21 and adapted to be slidable relative to portion 20 and to carry extrusion 13. Both portions 20 and 21 may be formed of any suitable metallic materials.

Wall mountable portion 20 includes a plate member 22 which, for ease of fabrication, may be formed with windows 23 therein. L-shaped opposed track members 24 extend forwardly from plate 22 adjacent to the outer lateral edges of windows 23. Opposed arms 25 extend rearwardly from plate 22 at upper and lower corners thereof of one lateral edge of plate 22, and a second set of opposed arms 26 extend rearwardly from plate 22 at the upper and lower corners of the other lateral edge of plate 22. Arms 25 are each provided with lugs 27 extending angularly from the ends thereof opposite to plate 22, and arms 26 are provided with lugs 28 extending laterally outward from the ends thereof opposite to plate 22. Arms 25 are spaced from each other, and arms 26 are spaced from each other, a predetermined distance determined by the conventional vertical spacing of pegboard holes 16 so that they will be aligned with such holes so that bracket portion 20 may be mounted to wall 15 in a manner to be hereinafter described. Arms 25 and 26 are also of a length generally coincident to the thickness of wall 15 so that bracket portion 20 will snugly engage wall 15.

Figure 2:
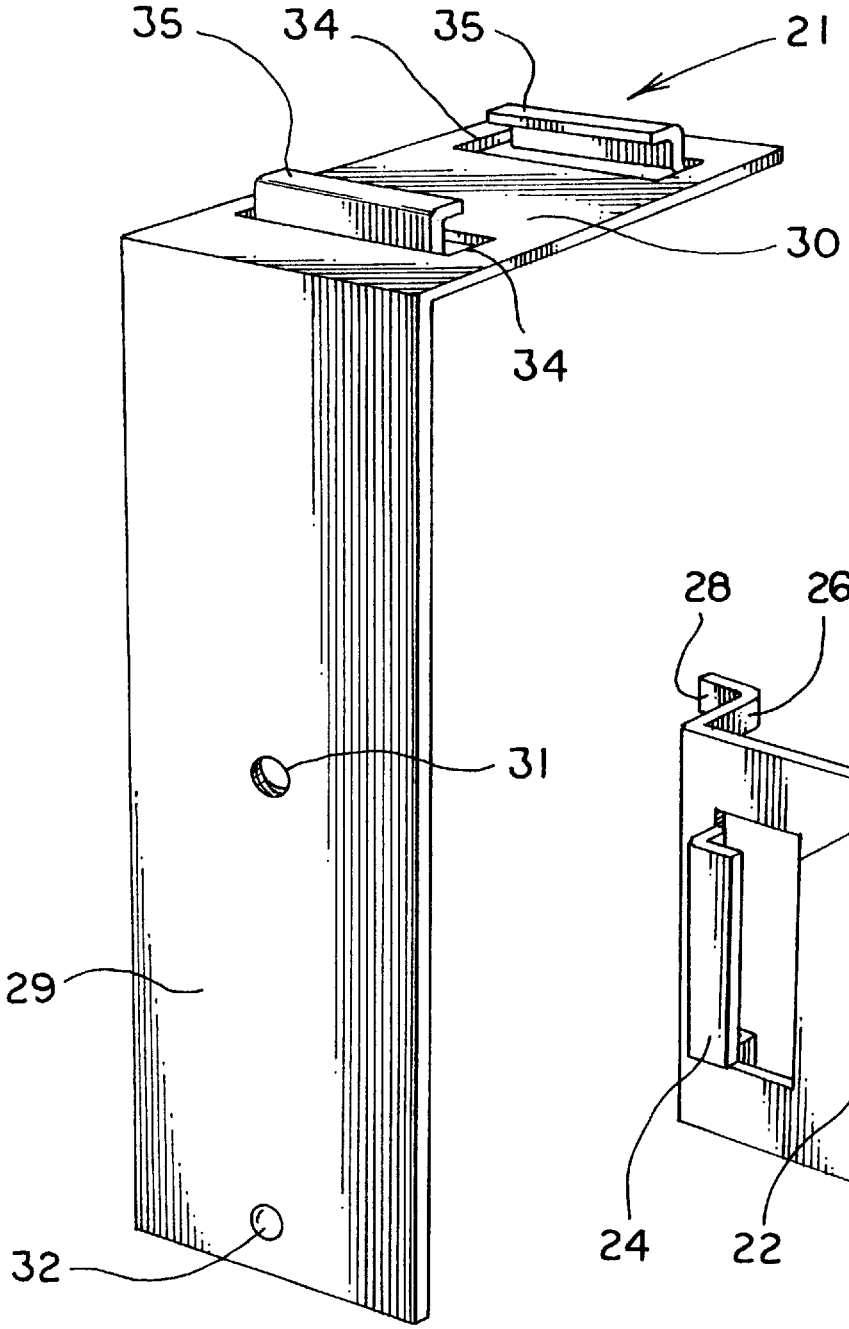
FIG. 2 is a perspective view of one portion of a bracket assembly made in accordance with the present invention.
Figure 3:
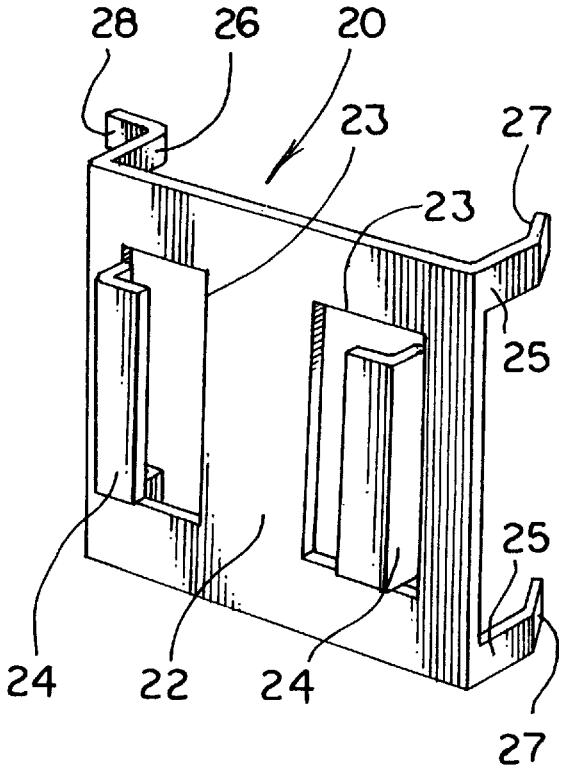
FIG. 3 is a perspective view of another portion of a bracket assembly made in accordance with the present invention
Figure 4:
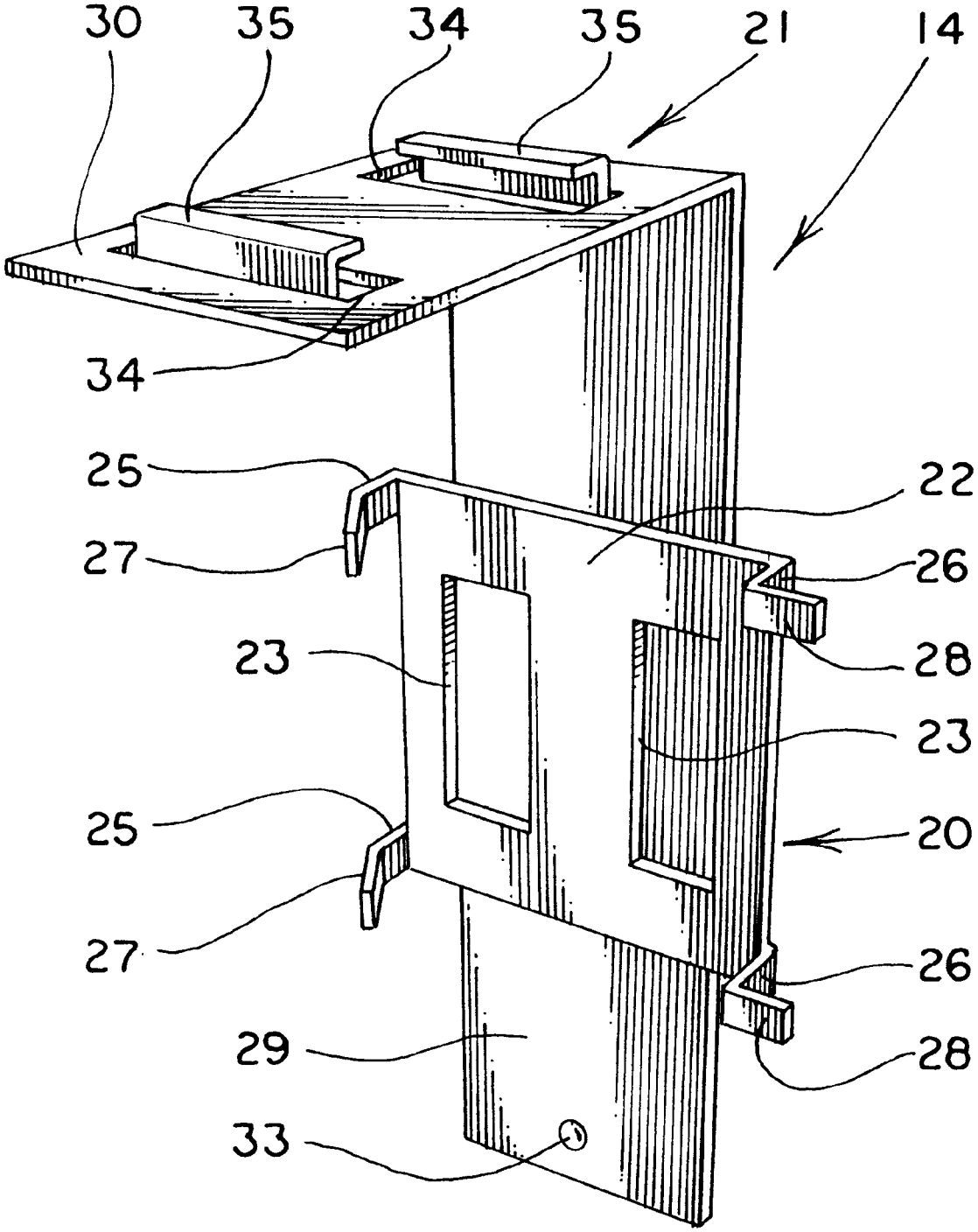
FIG. 4 is a perspective view of the portions of a the bracket assembly assembled and showing the portions as viewed from the sides opposite to that shown in FIGS. 2 and 3.

Slide portion 21 of each bracket assembly 14 is L-shaped in nature having a downwardly directed slide plate 29 joined at its upper end to a horizontally directed support plate 30. Slide plate 29 is shown in FIG. 2 as having a generally centrally located threaded aperture 31 therein and a depression 32 formed near the bottom thereof, which depression 32 forms a protuberance 33 on the other side of plate 29 as shown in FIG. 4. For ease of fabrication, support plate 30 can be formed with windows 34 therein and L-shaped opposed track members 35 extend upwardly from the lateral outer edges of windows 34.

It should be noted that bracket portions 20 and 21 are normally preassembled to form bracket assembly 14. To this end, slide plate 29 of portion 21 is positioned between track members 24 of portion 20. As such, portions 20 and 21 are slidable relative to each other but because the bottom of plate 22 of portion 20 will engage protuberance 33 of plate 29 of portion 21, portion 20 cannot fall off of portion 21 and thus bracket portions 20 and 21 are always maintained together which is particularly advantageous when storing a plurality of bracket assemblies 14 for subsequent use.

Sign-supporting holder 13 may be extruded of any suitable plastic material and may take on any of a number of selected configurations, one such configuration being shown in FIG. 5. The configuration shown includes an outer, elongate base extrusion, generally indicated by the numeral 36, and a separate, elongate inner extrusion, generally indicated by the numeral 37.

Base extrusion 36 includes a bottom surface 38 with spaced walls 39 extending upwardly therefrom. Bottom surface 38 extends laterally outwardly of walls 39 to form rails 40. Sign-engaging tabs 41 extend inwardly toward each other at the top of walls 39 and similar tabs 42 extend inwardly toward each other near the bottom of walls 39.

Inner extrusion 37 is adapted to be inserted into or received within base extrusion 36 and includes a bottom surface 43 adapted to rest on bottom surface 38 of base extrusion 36. Spaced walls 44 extend upwardly from bottom surface 43 of inner extrusion 37 and are provided with sign-engaging tabs 45 extending laterally in both directions from the top of walls 44. Tabs 45 of walls 44 are thus opposed to tabs 41 of walls 39 of base extrusion 36 and are likewise opposed to each other. Sign-engaging tabs 46 are likewise provided near the bottom of walls 44 and are opposed to tabs 42 of walls 39 of base extrusion 36, as well as being opposed to each other.

Because of this configuration of extrusion member 13, three sign-receiving slots 47 are formed therein. Display sign 12 may be longitudinally positioned in any one of slots 47 and it is engaged between upper tabs 41 and 45 (or between opposed upper tabs 45 if positioned in the center slot 47) and between lower tabs 42 and 46 (or between opposed lower tabs 46 if positioned in the center slot 47). It should be evident that this configuration also allows for up to three signs 12 to be positioned adjacent to each other and provides the merchandiser with many options. For example, if fixture 11 is an aisle wall, two signs 12 can be placed in the laterally outer slots 47 to display messages in adjoining aisles.

It should also be evident that extrusion member 13 could be alternatively configured. For example, the inner extrusion 37 could be eliminated and walls 39 of base extrusion 36 could be formed closer together to engage a sign 12. Or inner extrusion 37 could be formed with one vertical wall 44 thereby forming two sign-receiving slots 47, all without departing from the concepts of the present invention.

The manner in which system 10 is assembled utilizing bracket assemblies 14 will now be described with particular reference to FIG. 5. A bracket assembly 14 is attached to wall 15 by positioning the ends of lugs 28 of bracket portion 20 adjacent to and aligned with two vertically spaced apertures 16 of wall 15. Lugs 28 are then inserted through those apertures 16 and the bracket assembly 14 is rotated ninety degrees to the FIG. 5 position whereupon lugs 27 and arms 25 of bracket portion 20 may be snapped through two vertically spaced apertures 16 of wall 15. The second bracket assembly 14 is affixed to wall 15 in a similar fashion, it being understood that for very small signs 12 only one bracket assembly may be necessary and for very long longitudinally extending signs, more than two bracket assemblies 14 may be desirable.

The height of bracket assemblies 14 may now be adjusted to the desired height by sliding bracket portion 21 relative to bracket portion 20, that is, by sliding plate 29 within track members 24. When the desired height is established, a set screw 48 may be threaded into aperture 31 of slide plate 29 of bracket portion 21. Set screw 48 thus can engage plate 22 of bracket portion 20 to maintain bracket assembly 14 at the desired height. If more than one bracket assembly 14 is being employed, they can all be adjusted to the same predetermined height. Such height can be anywhere from a position where support plate 30 is generally resting on top cap 19 of fixture 11 to a position, as shown in FIG. 5, where it is spaced therefrom. This height can be dictated by several factors. For example, if items to be displayed are positioned on a shelf or shelves mounted near the top of wall 15, then bracket assemblies 14 may have to be positioned higher so that the sign 12 is not obscured by the item. The adjustable nature of bracket assemblies 14 is also advantageous in that the upper position of the top row of apertures 16 in pegboard walls 15 can vary from wall to wall such that if in a particular wall 15, the top row of apertures 16 is lower than normal, bracket assembly 14 can be extended to accommodate the difference.

With the bracket assemblies 14 adjusted to the desired height, the longitudinally extending extrusion 13, with its sections 36 and 37 having been assembled as previously described, may now be positioned on bracket assemblies 14. Such is accomplished by inserting rails 40 of extrusion 13 and sliding them through track members 35 which extend upward from support plate 30 of bracket portion 21. Of course, rails 40 are slidable through the track members 35 of all bracket assemblies 14 being utilized. One or more signs 12 may now be selectively positioned in the slots 47 of extrusion 13, as previously described, and the assembly of system 10 is complete.

It should thus be evident that a retail display system with its adjustable bracket assemblies constructed as described herein accomplishes the objects of the present invention and otherwise substantially improves the retail display art.

I claim:

1. A bracket assembly to attach a sign to a display fixture comprising a first bracket portion attachable to the fixture, and a second bracket portion slidable relative to said first bracket portion and adapted to carry the sign, such that the sliding of said second bracket portion relative to said first bracket portion positions the sign at a predetermined height relative to the fixture.

2. A bracket assembly according to claim 1 wherein said first bracket portion includes a plate, and lugs carried by said plate so that said plate can be attached to the fixture.

3. A bracket assembly according to claim 2 wherein said first bracket portion includes second lugs carried by said plate so that said plate can be attached to the fixture.

4. A bracket assembly according to claim 3 wherein the fixture includes a pegboard wall having apertures therein adapted to receive said lugs and said second lugs.

5. A bracket assembly according to claim 1 wherein said first bracket portion includes tracks to slidably receive said second bracket portion.

6. A bracket assembly according to claim 5 wherein said second bracket portion includes a plate slidable in said tracks.

7. A bracket assembly according to claim 6 wherein said first bracket portion includes a plate carrying said tracks, and further comprising means extending through said plate of said second bracket portion to engage said plate of said first bracket portion to hold said second bracket portion at a predetermined position relative to said first bracket portion.

8. A bracket assembly according to claim 6 further comprising means formed on said plate of said second bracket portion to prohibit said plate of said first bracket portion from separating from said second bracket portion.

9. A bracket assembly to attach a sign to a display fixture comprising a first bracket portion attachable to the fixture, and a second bracket portion slidable relative to said first bracket portion and having a plate adapt to support the sign, such that the sign can be carried at a predetermined position relative to the fixture.

10. A bracket assembly according to claim 9 further comprising a member having rails and adapted to carry a sign, said plate having tracks thereon to receive said rails.

11. A retail display system comprising a fixture, at least one bracket assembly having a first portion and a second portion, said first portion being attached to said fixture, and a sign carried by said second portion above said fixture, said second portion of said bracket assembly being movable relative to said first portion to adjust the height of said sign relative to said fixture.

12. A retail display system according to claim 11 wherein said first bracket portion includes a plate, and lugs carried by said plate so that said plate can be attached to said fixture.

13. A retail display system according to claim 12 wherein said first bracket portion includes second lugs carried by said plate so that said plate can be attached to said fixture.

14. A retail display system according to claim 13 wherein said fixture includes a pegboard wall having apertures therein, said lugs and said second lugs being received through said apertures.

15. A retail display system according to claim 13 wherein said first bracket portion includes tracks to slidably receive said second bracket portion.

16. A retail display system according to claim 15 wherein said second bracket portion includes a plate slidable in said tracks.

17. A retail display system comprising a fixture, at least one bracket assembly having a first portion and a second portion, said first portion being attached to said fixture, a member attached to said second portion, and a sign carried by said member, said second portion of said bracket assembly being movable relative to said first portion to adjust the position of said sign relative to said fixture.

18. A retail display system according to claim 17 wherein said member includes an outer base having rails formed thereon.

19. A retail display system according to claim 18 wherein said second portion includes tracks, said rails being received within said tracks.

20. A retail display system according to claim 18 wherein said member includes an insert received within said base, said base and said insert having spaced walls, said sign being received between selected of said spaced walls.

21. A retail display system according to claim 20 further comprising opposed tabs on said walls, said tabs on said selected of said spaced walls engaging said sign.

22. A retail display system comprising a fixture, at least one bracket carried by said fixture, and a sign carrying member carried by said bracket, said bracket being adjustable in height relative to said fixture so that said sign carrying member can be adjustably positioned relative to said fixture.

23. A retail display system according to claim 22 wherein said bracket includes a first portion attached to said fixture and a second portion slidable relative to said first portion, said second portion carrying said sign carrying member.

24. A retail display system according to claim 23 further comprising means extending through said second portion to engage said first portion to hold said second portion at a predetermined position relative to said first portion.

25. A retail display system according to claim 23 further comprising means on said second portion to prohibit said first portion from separating from said second portion when said first portion is not attached to said fixture.

26. A bracket assembly to attach a sign to a display fixture having a top surface comprising a first plate adapted to be carried by the fixture and a second plate adapted to extend over and above the top surface of the fixture, said second plate being adapted to carry the sign.

27. A bracket assembly according to claim 26 further comprising a third plate attachable to the fixture and receiving said first plate, said first plate being movable relative to said third plate.

* * * * *